US007874506B2

(12) United States Patent
Wang et al.

(10) Patent No.: US 7,874,506 B2
(45) Date of Patent: Jan. 25, 2011

(54) TOP AND SIDE LOADING SHREDDER WITH OPTIONAL HANDLE

(75) Inventors: Tie Chun Wang, Taipei (TW); Simon Huang, Taipei (TW); Herman Chang, Palos Verdes Peninsula, CA (US)

(73) Assignee: Michilin Prosperity Co., Ltd. (TW)

( * ) Notice: Subject to any disclaimer, the term of this patent is extended or adjusted under 35 U.S.C. 154(b) by 279 days.

(21) Appl. No.: 12/006,659

(22) Filed: Jan. 4, 2008

(65) Prior Publication Data

US 2008/0173741 A1 Jul. 24, 2008

Related U.S. Application Data

(63) Continuation-in-part of application No. 11/650,274, filed on Jan. 5, 2007, now Pat. No. 7,398,936.

(51) Int. Cl.
*B02C 19/00* (2006.01)

(52) U.S. Cl. ..... 241/100; 241/285.1

(58) Field of Classification Search ..... 241/100, 241/236, 285.1–285.3

See application file for complete search history.

(56) References Cited

U.S. PATENT DOCUMENTS

| | | | |
|---|---|---|---|
| 4,023,702 | A | 5/1977 | McKnight |
| 4,550,828 | A | 11/1985 | Baldwin et al. |
| 4,650,127 | A | 3/1987 | Radwanski et al. |
| 4,815,670 | A | 3/1989 | Iwai |
| 4,821,967 | A | 4/1989 | Moriyama |
| 4,832,293 | A | 5/1989 | Gizzi |
| 4,842,205 | A | 6/1989 | Araki et al. |
| 4,893,759 | A | 1/1990 | Mizobata |
| 4,957,243 | A | 9/1990 | Kanagaki et al. |
| 4,982,907 | A | 1/1991 | Sedgwick et al. |
| 5,071,080 | A | 12/1991 | Herbst et al. |
| 5,188,301 | A | 2/1993 | Hasegawa |
| 5,474,243 | A | 12/1995 | Schwelling |
| 5,535,474 | A | 7/1996 | Salazar |

(Continued)

FOREIGN PATENT DOCUMENTS

DE 2214800 A1 9/1973

(Continued)

OTHER PUBLICATIONS

"Standard for Media Standardized Names", fttp:ftp.pwg.org/pub/pwg/standards/pwg5101.1.pdf, Feb. 26, 2002, pp. 1-20.

(Continued)

*Primary Examiner*—Faye Francis
(74) *Attorney, Agent, or Firm*—Venable LLP; Stefan J. Kirchanski; Deborah A. Feinblum

(57) ABSTRACT

The present invention relates generally to shredder openings or throats. Specifically, this invention teaches a shredder housing with a top throat to allow material to be disposed of from above the shredder, as well as a side throat to allow for material to be disposed of from the side of the shredder. This is accomplished by placing a guiding member in the throat to assist both the top and side input. In addition, two side throats substantially opposite each other allow for multiple users to simultaneously use the shredder. Finally, the guiding member can serve as a handle to assist in lifting the housing from the base.

3 Claims, 6 Drawing Sheets

U.S. PATENT DOCUMENTS

| | | | | |
|---|---|---|---|---|
| 5,609,307 | A | 3/1997 | Rota | |
| 5,954,280 | A | 9/1999 | Kroger et al. | |
| 5,961,059 | A | 10/1999 | Kroger | |
| 6,065,696 | A | 5/2000 | Tsai | |
| 6,135,310 | A | 10/2000 | Svehaug | |
| 6,241,170 | B1 | 6/2001 | St. Clair | |
| 6,321,811 | B1 | 11/2001 | Atkinson et al. | |
| 6,460,790 | B1 | 10/2002 | Wu Huang | |
| 6,550,701 | B1 | 4/2003 | Chang | |
| 6,676,050 | B2 * | 1/2004 | Chang | 241/37.5 |
| 6,684,928 | B2 | 2/2004 | Dieckmann | |
| 6,765,193 | B2 | 7/2004 | Sumriddetchkajorn | |
| 7,025,293 | B2 | 4/2006 | Matlin et al. | |
| 7,213,780 | B2 * | 5/2007 | Chen | 241/100 |
| 7,398,936 | B1 * | 7/2008 | Wang | 241/100 |
| 7,500,627 | B2 * | 3/2009 | Park et al. | 241/36 |
| 2005/0072789 | A1 | 4/2005 | Einav et al. | |
| 2005/0072869 | A1 | 4/2005 | Ting | |
| 2006/0124789 | A1 | 6/2006 | Matlin et al. | |

FOREIGN PATENT DOCUMENTS

| | | | |
|---|---|---|---|
| DE | 2702147 | A1 | 7/1978 |
| DE | 3633109 | A1 | 3/1988 |
| DE | 10008442 | A1 | 8/2001 |
| EP | 0281136 | A2 | 9/1988 |
| EP | 0503957 | A1 | 9/1992 |
| EP | 0505109 | A1 | 9/1992 |
| EP | 1127621 | A2 | 8/2001 |
| FR | 7637761 | | 7/1978 |
| FR | 7706557 | | 10/1978 |
| GB | 2171029 | A | 8/1986 |
| JP | 06312144 | A | 11/1994 |

OTHER PUBLICATIONS

A.D. Dunn, "Notes on the Standardization of Paper Sizes", 1972.
Linda Schamber, "Optical Disk Formats: A Briefing", ERIC Digest, May 1988.
"Intimus Schleicher International 501 CD" Spare Parts List, First Edition Aug. 1999.
"Intimus Document Shredders," Schleicher & Co. International AG, Catalogue 89/90, pp. 21-23. Aug. 2010.
Guidelines for Patent Claim Construction Post-Phillips, The Basics of a "Markman" Hearing, Federal Circuit Bar Association, May 2006, pp. 1-17.
Manual of Patent Examination Procedure, 8th Edition, Aug. 2001, Rev. Oct. 2005, United States Patent Trademark Office, pp. 1400-96-1400-99.
Manual of Patent Examination Procedure, 8th Edition, Aug. 2001, Rev. May 2004, United States Patent and Trademark Offices, pp. 2100-46-2100-47.
Manual of Patent Examination Procedure, 8th Edition, Aug. 2001, Rev. Aug. 2005, United States Patent and Trademark Office, pp. 700-4-700-8.
Material & Packaging Technologies, Advanced Packaging Technology, http://www.astri.org/en/mpt_pc06_ors.php, Sep. 2010.
"Optical Emitter and Sensor Pair", TT Electronics, Optek Technology, Jan. 2006, Issue A.1, , pp. 1-3.
"Technology Category Descriptions: Optoelectronic Components", TT Electronics, http://www.optekinc.com/products/opto_comp_description.asp, Aug. 2010.
"Technology Category Descriptions: Optoelectronic Assmblies", TT Electronics, http://www.optekinc.com/products/opto_assemblies_description.asp, Aug. 2010.
"Transmissive Optical Sensor with Phototransitor Output", Vishay Semiconductors, TCST1210, Doc. No. 83769, Rev. A1. Jun. 8, 1999, pp. 1-6.
"Reflective Sensor for Touchless Switch", Vishay Semiconductors, TCND3000, Doc. No. 84606, Rev. 1.1, Nov. 2, 2004, pp. 1-8.
"Transmissive Optical Sensor with Phototransitor Output", Vishay Semiconductors, TCST110 up to TCST230, Doc. No. 8364, Rev. A5 Jun 8, 1999, pp. 1-9.
"Changes to Implement the Patent Business Goals" Rules and Regulations, Federal Register, vol. 65, No. 175, Friday, Sep. 8, 2000.pp. 54604, 54633.
Kobra 240 SS5 Electronic Data Media Shredder. Advertisement. http://www.elcoman.it, Aug. 2010.
Panasonic KX-4100 Auto-Feed Paper Shredder Photograph, Service Manual and Supplement-1 to the Service Manual, Aug. 2010.
Card Shredder Brochure, Schleicher & Co. AG, Aug. 2010.

* cited by examiner

FIG. 5
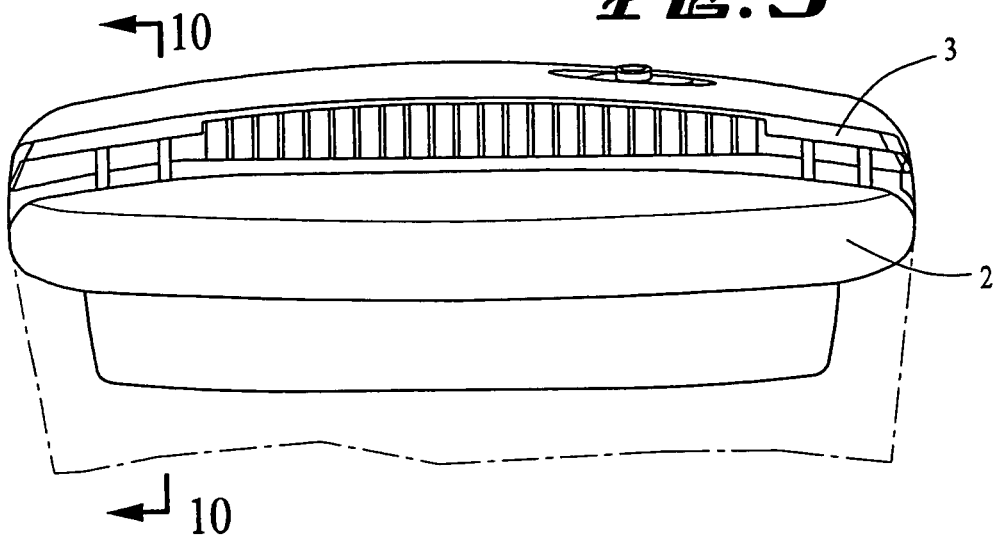
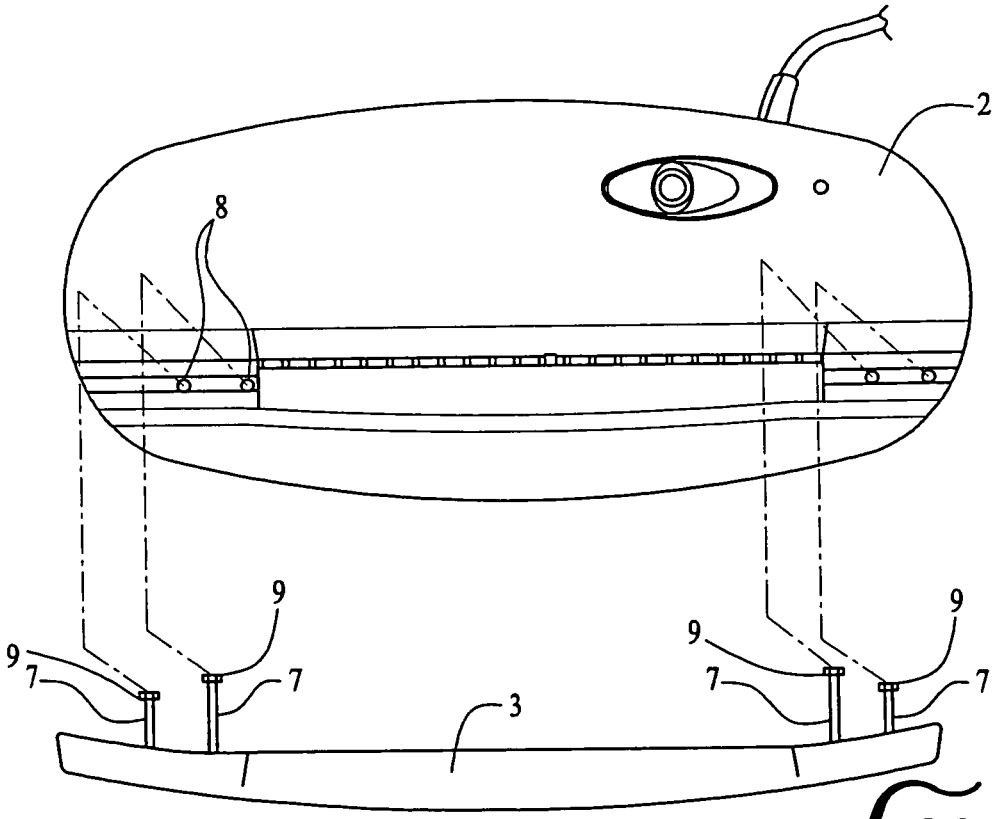
FIG. 6

TOP AND SIDE LOADING SHREDDER WITH OPTIONAL HANDLE

CLAIM OF PRIORITY

This application is a continuation-in-part application of Ser. No. 11/650,274, filed Jan. 5, 2007 now U.S. Pat. No. 7,398,936 which issued on Jul. 15, 2008.

BACKGROUND OF THE INVENTION

1. Field of the Invention

The present invention relates generally to the openings through which materials to be shredded are fed into shredders. Specifically, this invention discloses a shredder housing with at least two openings or throats which allow paper, plastic, and other forms of media that hold information to be fed into a shredder from either the top of the shredder or from the side(s) of the shredder. If two side throats are employed, the side throats are preferably on substantially opposite sides of the shredder housing. In addition, a third throat may be placed on the top of the shredder housing. Finally, the invention discloses a convenient handle for lifting up the shredder housing.

2. Background Information

With increased privacy concerns, shredders have become an integral part in both homes and businesses. Though originally used to destroy paper products, shredders are now used to shred other forms of media that hold information, such as compact discs. In addition, credit cards and other plastic products are commonly shredded.

Prior art shredders have an opening or throat on the top of the housing through which material to be shredded is inserted. If the shredder is situated in an open area with nothing obstructing the top of the shredder then this configuration is convenient.

However, a problem occurs if the shredder is placed underneath a desk or other piece of furniture. In this situation, the overhead obstruction may prevent insertion of materials to be shredded into the top throat. Accordingly, the present invention seeks to employ another side throat through which material to be shredded can be inserted.

One preferred embodiment of the claimed invention provides this by adding a guiding member to a side throat which allows for both top and side input of material. Additionally, the guiding member can be used as a handle to assist in lifting the housing from the base, thus allowing the contents of the base to be discarded. Since the housing can be heavy due to the shredder mechanism inside, the guiding input/handle facilitates removal of the housing mechanism from the shredder base.

The heavy weight of the shredder can also make it difficult for a user to move it. If more than one person is shredding material, it can be difficult to move the shredder back and forth between the two people. The present invention alleviates this issue by having two throats on opposing sides of the shredder which feed into the same shredding mechanism. Multiple users can thus feed material into the shredder simultaneously from opposite sides. The shredder may also have a third, top throat which feeds into the same shredding mechanism.

From the preceding descriptions, it is apparent that the devices currently being used have significant disadvantages and/or limitations. Thus, important aspects of the technology used in the field of invention remain amenable to useful refinement.

SUMMARY OF THE INVENTION

The present invention relates to an apparatus that satisfies the need for a shredder housing that allows for both top and side input of material to be shredded, as well as for a handle to readily assist in removal of the housing from the base.

In one preferred embodiment, a guiding member is placed in the throat of a shredder which allows for material to be inserted through both the top and side of the shredder housing. Material inserted through the top feeds straight down into the shredder mechanism. Material inserted through the side of the shredder housing is initially inserted into the housing parallel to the ground. The material then slides along the side wall of the guiding member and curves downward until it is substantially perpendicular to the ground where it then enters the shredding mechanism. In addition to guiding the material into the shredder, the guiding member can also be lifted up and serve as a handle to assist in lifting the housing from the base.

In another preferred embodiment, the shredder housing has two side throats that substantially oppose each other and feed into the same shredding mechanism, thus allowing two users to simultaneously shred materials from opposite sides. The shredder may also have a third, top throat.

All of the foregoing operational principles and advantages of the present invention will be more fully appreciated upon consideration of the following detailed description with reference to the drawings.

BRIEF DESCRIPTION OF THE DRAWINGS

The features and advantages of this invention are better understood with regard to the following drawings, description, and claims. The drawings consist of the following:

FIG. 5 is a side view of a shredder housing embodying features of this invention.

FIG. 6 is a top plan view of a shredder housing embodying features of this invention and a side view of the guiding member embodying features of this invention.

DETAILED DESCRIPTION OF THE INVENTION

Figure 1:
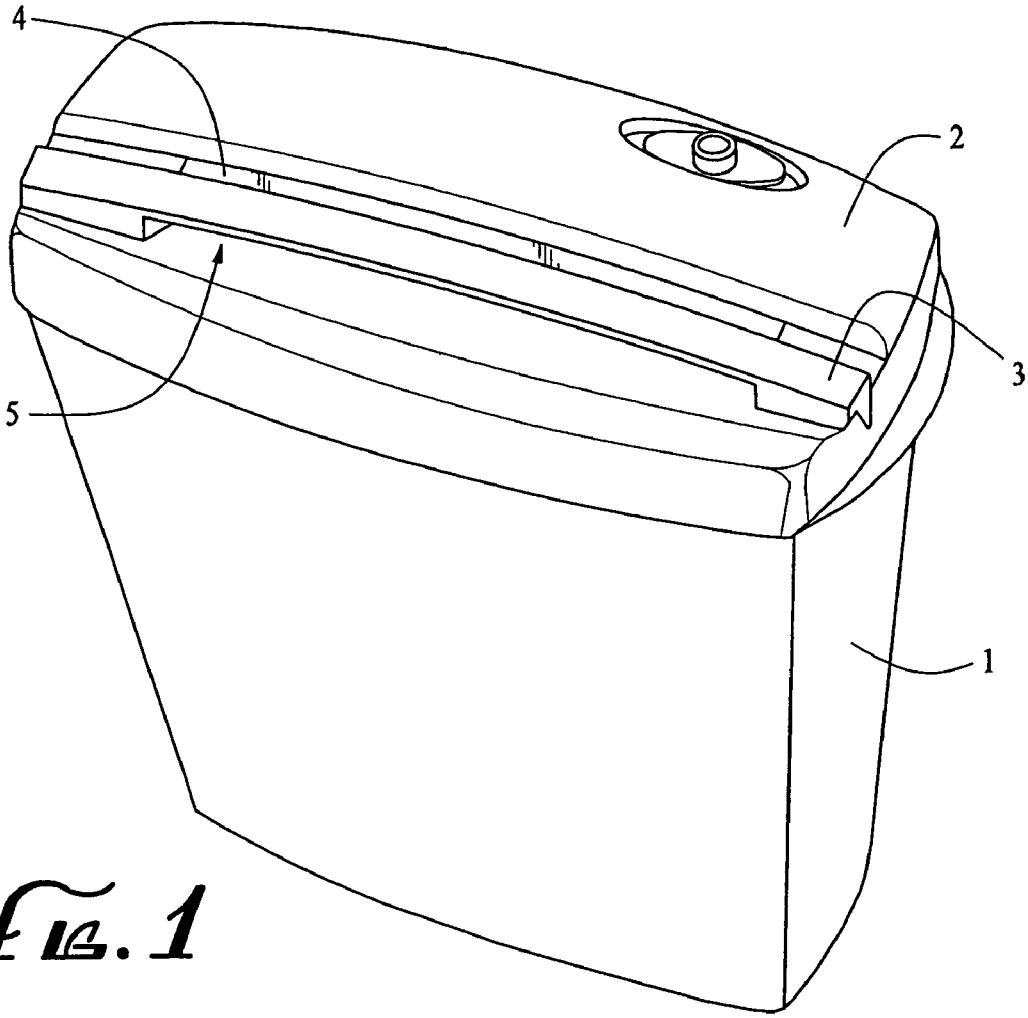
FIG. 1 is a perspective view of a shredder embodying features of this invention.
Figure 2:
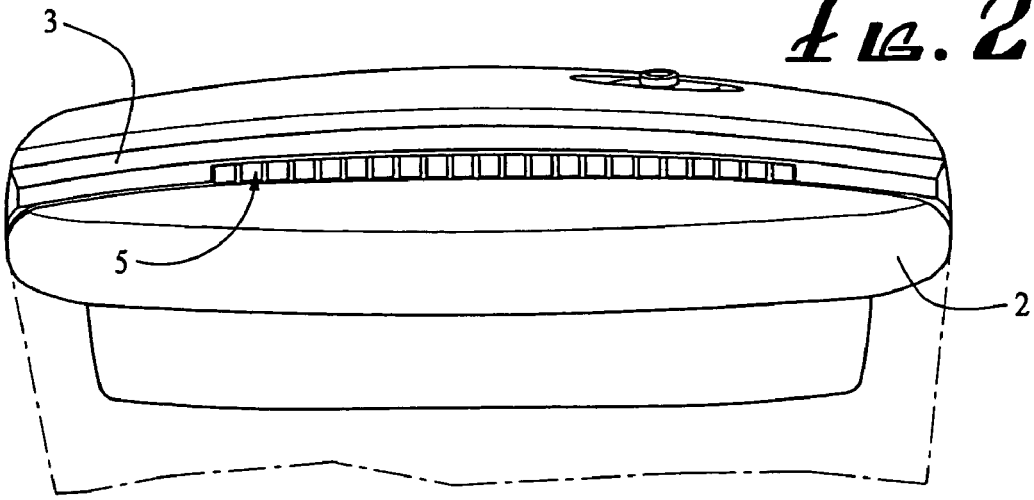
FIG. 2 is a side view of a shredder housing embodying features of this invention.
Figure 3:
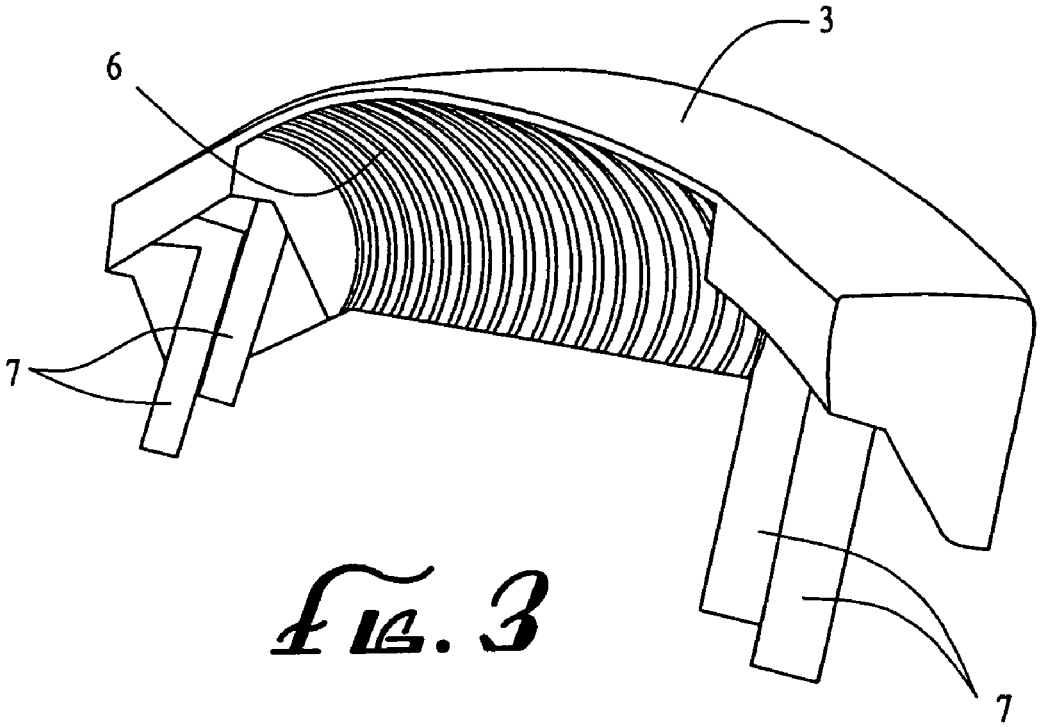
FIG. 3 is an exploded perspective view of the guiding member embodying features of this invention.
Figure 4:
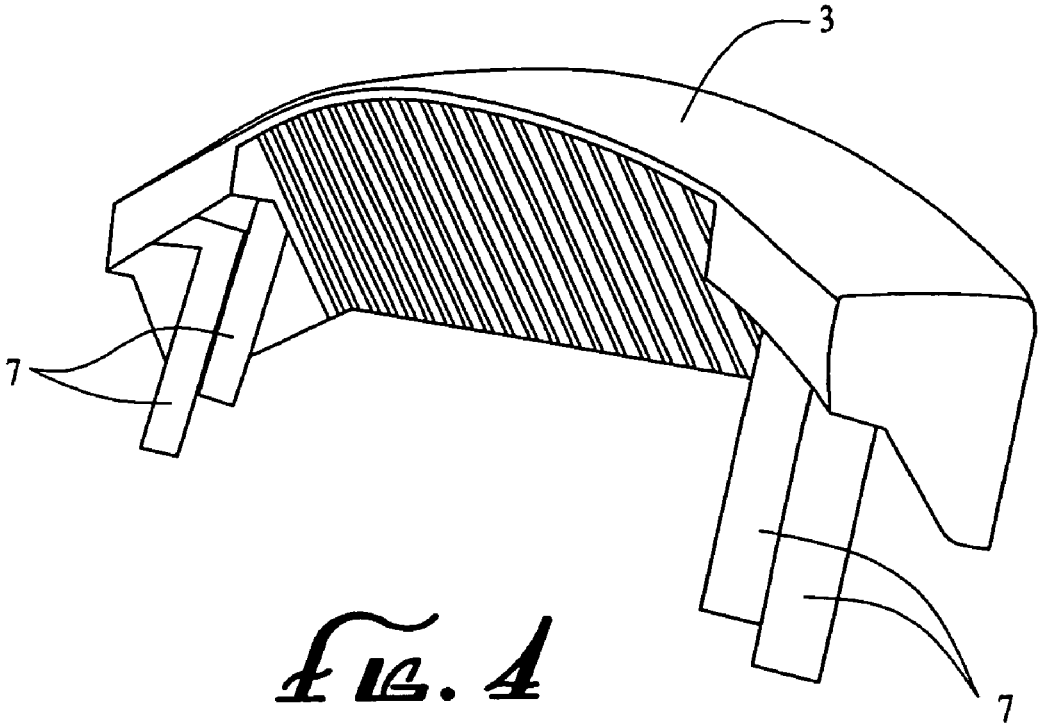
FIG. 4 is an exploded perspective view of another guiding member embodying features of this invention.
Figure 7:
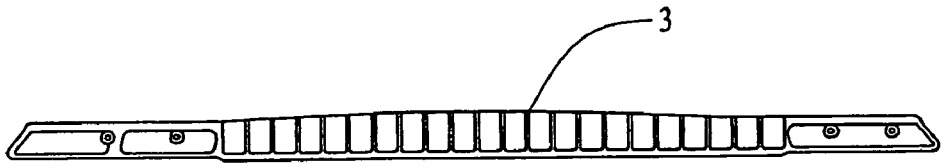
FIG. 7 is a bottom plan view of the guiding member embodying features of this invention.
Figure 8:
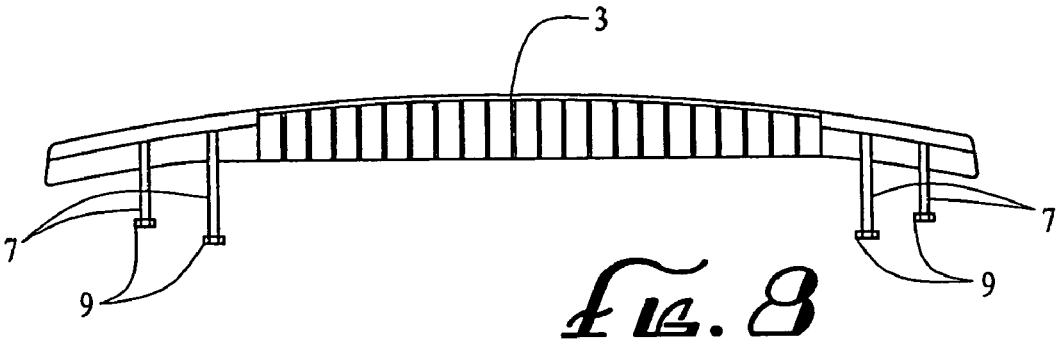
FIG. 8 is a side view of the guiding member embodying features of this invention.
Figure 9:
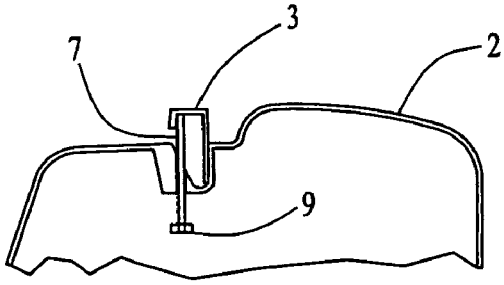
FIG. 9 is a cross sectional view of the side of a housing embodying features of this invention.
Figure 10:
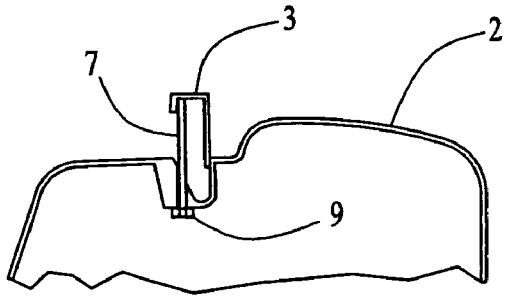
FIG. 10 is a cross sectional view of the side of a housing embodying features of this invention.
Figure 12:
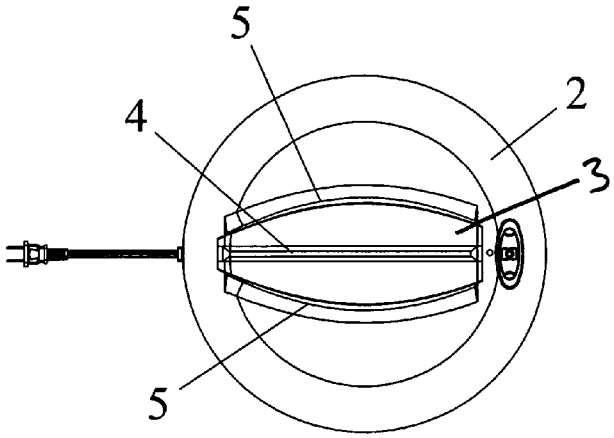
FIG. 12 is a top plan view of a shredder embodying features of this invention.
Figure 11:
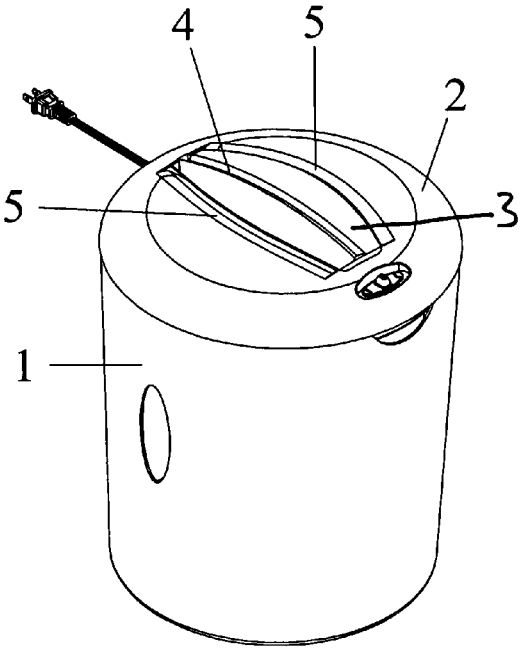
FIG. 11 is a perspective view of a shredder embodying features of this invention.
Figure 13:
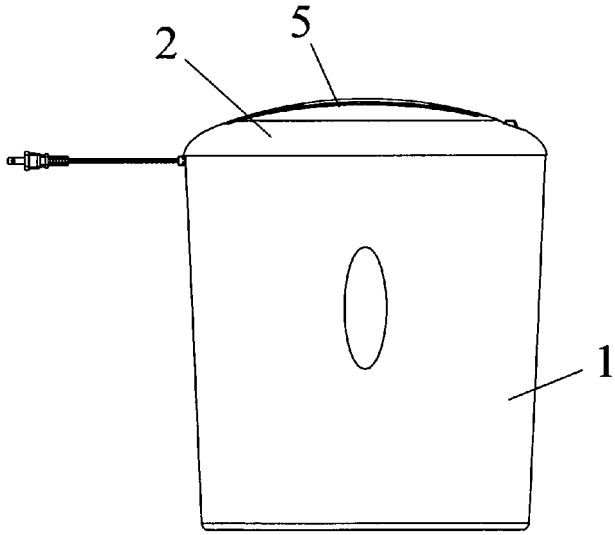
FIG. 13 is a side view of a shredder embodying features of this invention.
Figure 15:
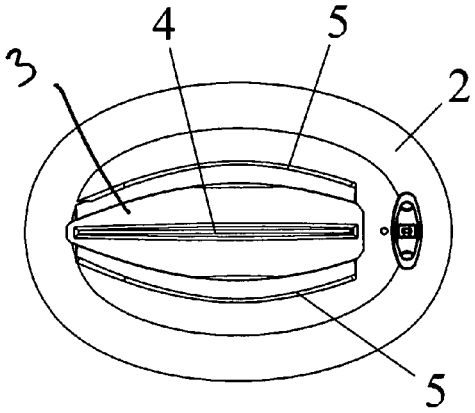
FIG. 15 is a top plan view of a shredder embodying features of this invention.
Figure 14:
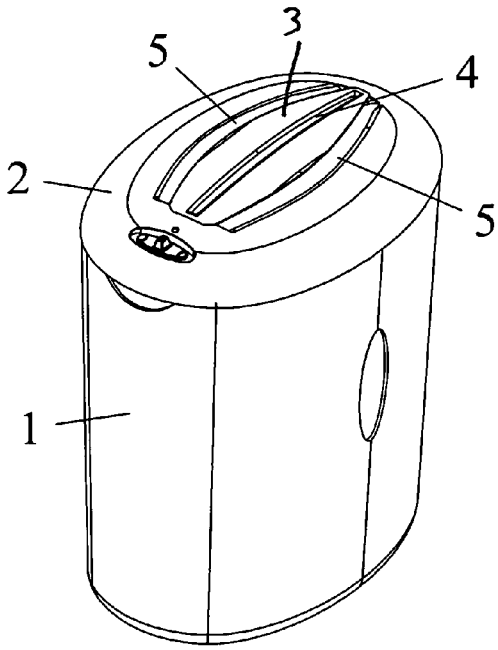
FIG. 14 is a perspective view of a shredder embodying features of this invention.
Figure 17:
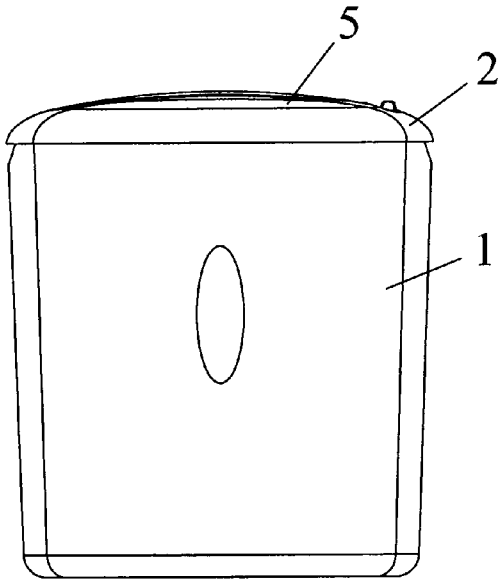
FIG. 17 is a side view of a shredder embodying features of this invention.
Figure 16:
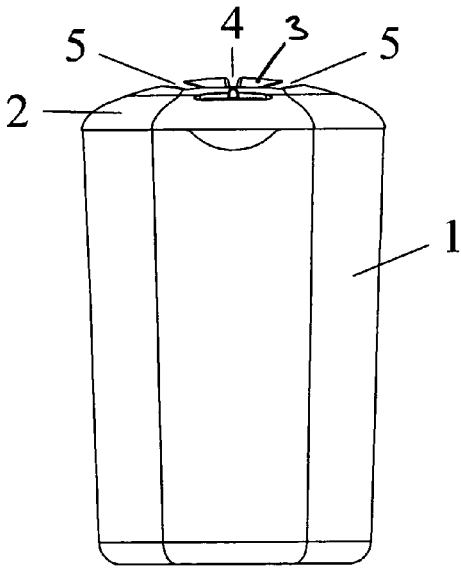
FIG. 16 is a side view of a shredder embodying features of this invention.

The essential elements of a shredder are comprised of a base 1, a housing 2, and a shredder mechanism which resides in the housing. The shredder mechanism can be of any sort commonly known to those skilled in the art and is thus not described herein.

The housing 2 has an opening or throat that leads to the shredding mechanism. Material to be shredded is then fed through the throat and into the shredding mechanism.

This invention discloses a guiding member 3 which allows material to be inserted into either the top throat 4 or side throat 5 of the shredder. As detailed below, the guiding member 3 may also serve as a handle to assist in lifting and carrying the housing 2 from the base 1.

FIGS. 1-10 disclose a preferred embodiment of a shredder housing 2 with top and side throats. As shown in FIG. 1, material to be shredded can be inserted from above the shredder into the top throat 4. Material fed from above goes directly through the top throat 4 and into the shredder mechanism.

If the shredder is in a location which does not allow for material to be inserted from the top (such as under a desk), then the side throat 5 can be used. See FIG. 2. In this situation, when material is inserted into the side throat 5, the guiding member 3 facilitates the feeding of material into the shredding mechanism.

The guiding member 3 has a curved side wall 6 bordering the upper portion of the side throat 5 which facilitates the insertion of flexible materials to be shredded into the shredder mechanism. See FIG. 3. Material inserted through the side throat 5 of the shredder housing 2 which when initially fed is parallel to the ground, slides along the curved side wall 6 of the guiding member. The curved side wall 6 curves the flexible material downward until it is substantially perpendicular to the ground where it then enters the shredder mechanism. The opposite side of the curved side wall 6 which borders one side of the top throat is substantially straight and facilitates material insertion of material into the top throat 4.

It should be appreciated that although this preferred embodiment discloses a curved side wall 6 for feeding flexible materials into the shredder, inflexible materials can also be fed into the shredder mechanism via a wall that is not curved, but straight and angled directly into the shredding mechanism. See FIG. 4.

The guiding member 3 may also serve as a handle to assist in lifting the shredder housing 2. As seen in FIGS. 5-10, the guiding member 3 can be lifted upwards from the shredder housing 2 thus allowing the user to more readily grab a hold of the guiding member/handle.

The guiding member 3 has at least one post 7 towards each end which secure and align the guiding member 3 into mating apertures 8 in the housing. At the end of the posts 7 are appendages 9 which couple with the housing 2 when the guiding member is lifted vertically. See FIG. 10. When the guiding member 3 is in this position, it serves as a handle to assist in lifting the housing 2 when the contents of the base 1 need to be disposed of.

FIGS. 11-17 disclose another preferred embodiment where the shredder housing has two side throats 5. One side throat 5 is located on one half of the housing, and the other side throat 5 is located on the other half of the housing, such that the two side throats 5 are on opposite halves or opposing sides of the shredder housing 2. Each side throat 5 then feeds into the same shredding mechanism which is located inside the housing 2. This orientation allows for two people across from each other to simultaneously shred material.

The two side throats may be separated by a guiding member 3 which facilitates insertion of material into the shredding mechanism, as detailed above. A third, top throat 4 may also be located on top of the guiding member 3 between the two side throats. Materials fed through this top throat feed into the same shredding mechanism as the side throats. The guiding member 3, may also serve as a handle to assist in lifting the shredder housing 2. In such an embodiment, the guiding member 3 would be a separate component from the housing.

It should be appreciated that in embodiments where the guiding member is not a handle, the guiding member 3 may be integral to the housing. In addition, although this preferred embodiment discloses side throats which are substantially opposite from each other, other orientations are possible for the side throats. For example, the side throat may be positioned at other locations provided that the throat is curved such that material to be shredded is fed directly into the shredding mechanism. In addition, as disclosed above, inflexible materials can also be fed into the shredder mechanism via a wall that is not curved, but straight and angled directly into the shredding mechanism. Furthermore, although this preferred embodiment discloses a top throat, other embodiments include shredder housings with only two side throats.

Although the present invention has been described in detail with respect to certain preferred versions thereof, other versions are possible. Therefore, the scope of the claims should not be limited to the description of the preferred versions contained herein.

The invention claimed is:

1. A shredder housing comprising:

two side throats, wherein one side throat is located on one half of the housing, and the other side throat is located on the other half of the housing;

a top throat, wherein said top throat located between said two side throats;

and a shredding mechanism, wherein said two side throats and said top throat are capable of feeding material to be shredded into said shredding mechanism.

2. A shredder housing comprising:

two side throats, wherein one side throat is located on one half of the housing, and the other side throat is located on the other half of the housing;

one top throat, wherein said top throat is located between said two side throats;

a shredding mechanism, wherein said two side throats and the top throat are capable of feeding material to be shredded into said shredding mechanism; and a guiding member which facilitates insertion of material into the shredding mechanism, wherein said top throat is located on top of said guiding member.

3. The shredder housing of claim 2 wherein said guiding member can be pulled upward to serve as a handle to assist in carrying the shredder housing.

* * * * *